US009178318B2

(12) United States Patent
Rascon et al.

(10) Patent No.: US 9,178,318 B2
(45) Date of Patent: Nov. 3, 2015

(54) SHIELDED INTEGRATED CONNECTOR MODULES AND ASSEMBLIES AND METHODS OF MANUFACTURING THE SAME

(71) Applicant: PULSE ELECTRONICS, INC., San Diego, CA (US)

(72) Inventors: Thomas Rascon, Temecula, CA (US); Mohammad Saboori, San Diego, CA (US)

(73) Assignee: Pulse Electronics, Inc., San Diego, CA (US)

( * ) Notice: Subject to any disclaimer, the term of this patent is extended or adjusted under 35 U.S.C. 154(b) by 0 days.

(21) Appl. No.: 13/797,527

(22) Filed: Mar. 12, 2013

(65) Prior Publication Data

US 2013/0288526 A1 Oct. 31, 2013

Related U.S. Application Data

(60) Provisional application No. 61/639,739, filed on Apr. 27, 2012.

(51) Int. Cl.

| | |
|---|---|
| ***H01R 13/648*** | (2006.01) |
| ***H01R 13/6581*** | (2011.01) |
| ***H01R 13/6586*** | (2011.01) |
| *H01R 13/514* | (2006.01) |
| *H01R 13/66* | (2006.01) |

(52) U.S. Cl.
CPC ..... *H01R 13/6581* (2013.01); *H01R 13/6586* (2013.01); *H01R 13/514* (2013.01); *H01R 13/6658* (2013.01)

(58) Field of Classification Search
USPC ..... 439/607.23, 607.24, 607.25, 207.26
See application file for complete search history.

(56) References Cited

U.S. PATENT DOCUMENTS

| | | | | |
|---|---|---|---|---|
| 6,585,540 | B2 | 7/2003 | Gutierrez et al. | |
| 6,736,673 | B1 * | 5/2004 | Simmons et al. | 439/541.5 |
| 6,739,915 | B1 * | 5/2004 | Hyland et al. | 439/676 |
| 6,962,511 | B2 | 11/2005 | Gutierrez et al. | |
| 7,241,181 | B2 | 7/2007 | Machado et al. | |
| 7,300,307 | B2 * | 11/2007 | Murr et al. | 439/540.1 |
| 7,821,374 | B2 | 10/2010 | Harrison et al. | |
| 8,337,246 | B2 | 12/2012 | Zhang et al. | |
| 8,636,540 | B2 * | 1/2014 | Bu | 439/490 |
| 2006/0166550 | A1 * | 7/2006 | Murr et al. | 439/540.1 |
| 2011/0205009 | A1 | 8/2011 | Renteria | |
| 2012/0058676 | A1 | 3/2012 | Schaffer | |

FOREIGN PATENT DOCUMENTS

| | | |
|---|---|---|
| WO | WO2011/056967 | 6/2011 |
| WO | WO2011/056968 | 6/2011 |

* cited by examiner

*Primary Examiner* — Phuong Dinh
(74) *Attorney, Agent, or Firm* — Gazdzinski & Associates, PC

(57) ABSTRACT

High electrical isolation connector apparatus and methods. In one embodiment, an integrated connector module (ICM) is disclosed. The ICM includes a number of adjacent electronic subassemblies that are shielded through the use of an insert body shield. The insert body shield beneficially increases electrical isolation between adjacent subassemblies thereby further mitigating possible electrical noise. The insert body shield is configured to be received within a slot formed within the connector housing. An internal shield is also included that is received in a slot of an insert body of the electronic subassemblies, thereby effectively shielding adjacent component receiving cavities from one another. Methods and apparatus are also disclosed which make use and take advantage of these shielded ICMs. For example, telecommunications/networking equipment that incorporates these ICMs are also disclosed.

18 Claims, 16 Drawing Sheets

SHIELDED INTEGRATED CONNECTOR MODULES AND ASSEMBLIES AND METHODS OF MANUFACTURING THE SAME

PRIORITY

This application claims the benefit of priority to co-owned U.S. Provisional Patent Application Ser. No. 61/639,739 of the same title filed Apr. 27, 2012, the contents of which are incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TECHNOLOGICAL FIELD

The present disclosure relates generally to integrated connector modules and particularly to an improved design and method of manufacturing an integrated connector module having noise shielding and internal electronic components.

DESCRIPTION OF RELATED TECHNOLOGY

Integrated connector modules are well known in the electronic connector arts. There are several major considerations in designing and manufacturing such an integrated connector module, including without limitation: (i) shielding the individual connectors against externally generated electromagnetic interference (EMI) or "noise", (ii) shielding the individual connectors against internally generated EMI, (iii) shielding external electronic circuits from the electronic components within the integrated connector module, (iv) the size or volume consumed by the assembly, (v) reliability, and (vi) the cost of manufacturing.

With respect to EMI, prior art integrated connector modules are typically constructed from a molded plastic housing in which the individual connectors are integrally formed, and an external metallic noise shield which wraps around or envelops much of the external surface area of the connector housing. This approach of using merely an external "wrap-around" noise shield has several drawbacks, however. Specifically, such an arrangement does not provide complete or even near-complete shielding of the individual connectors in the assembly, since the bottom surface of the connector housing is often left largely unshielded (due to concerns of reduced reliability due to electrical shorting between the connector conductors and the metallic shield). Moreover, the port in which the modular plug is received is not shielded, thereby leaving the front face of the module largely open. These "gaps" in the shielding decreases the overall performance of the connector assembly by decreasing the signal-to-noise ratio (SNR) resulting from the increased noise.

Additionally, such wrap-around external shields do not address the issue of cross-connector noise leakage; i.e., noise radiated by the components of one connector in the assembly interfering with the signal of the other connectors, and vice-versa. Cross-connector noise leakage is particularly problematic as the data rates passing through the integrated connector module increase, and the density of electronic/electrical components within the assembly increases.

Since in general manufacturers and consumers are highly sensitive to the cost and pricing of integrated connector modules, there exists a constant tension between producing an integrated connector module which has the best possible (noise) performance for a given data rate, yet with the lowest possible cost. Hence, the most desirable situation is that where comprehensive external and cross-component noise shielding can be implemented with little impact on the cost of the finished product as a whole. Additionally, since board space ("footprint") and volume are such important factors in miniaturized electronic components, improvements in performance and noise shielding ideally should in no way increase the size of the component (and in fact, should allow for the possibility of possible future miniaturization).

Lastly, the integrated connector module must also optimally include signal filtering/conditioning components such as inductive reactors (i.e., "choke" coils), transformers, and the like, or even processing components such as RISC cores, power over Ethernet (PoE) components, controllers, network interface processors, etc. with no penalty in terms of space or noise performance.

Based on the foregoing, there is a salient need for an improved integrated connector module and method of manufacturing the same. Such an improved assembly would be reliable, and provide enhanced external and intra-connector noise suppression, including suppressing noise between integral electronic components and the substrate to which the assembly is mounted, while occupying a minimum volume and meeting high-speed data requirements. Additionally, such improved device could be manufactured easily and cost-efficiently.

SUMMARY

In a first aspect, an integrated connector module is disclosed. In one embodiment, the integrated connector module includes a connector housing having connector ports arranged in a row-and-column fashion. The integrated connector module also includes sets of electronic components disposed within one or more insert bodies, each of the sets of electronic components being associated with a given port or connector in the connector housing. Electromagnetic interference (EMI) reducing shields are also included that isolate each of the sets of electronic components from one another. An EMI reducing shield is also included in each of the insert bodies to facilitate the electrical isolation of each of the sets of electronic components from one another.

In a second aspect, networking apparatus that incorporate the aforementioned integrated connector module is disclosed.

In a third aspect, methods of manufacturing the aforementioned integrated connector module are disclosed.

In a fourth aspect, methods of manufacturing the aforementioned networking apparatus are disclosed.

In a fifth aspect, methods of using the aforementioned integrated connector modules are disclosed.

In a sixth aspect, shielding apparatus for use with the aforementioned integrated connector module are disclosed.

BRIEF DESCRIPTION OF THE DRAWINGS

The features, objectives, and advantages of the present disclosure will become more apparent from the detailed description set forth below when taken in conjunction with the drawings, wherein:

FIG. 1I is a perspective view of a pair of electronic subassemblies for use in the ICM illustrated in FIG. 1 in accordance with one embodiment of the present disclosure.

FIG. 1L is a perspective view of the underside of the lower printed circuit board of the ICM illustrated in FIG. 1 in accordance with one embodiment of the present disclosure.

Figure 1:
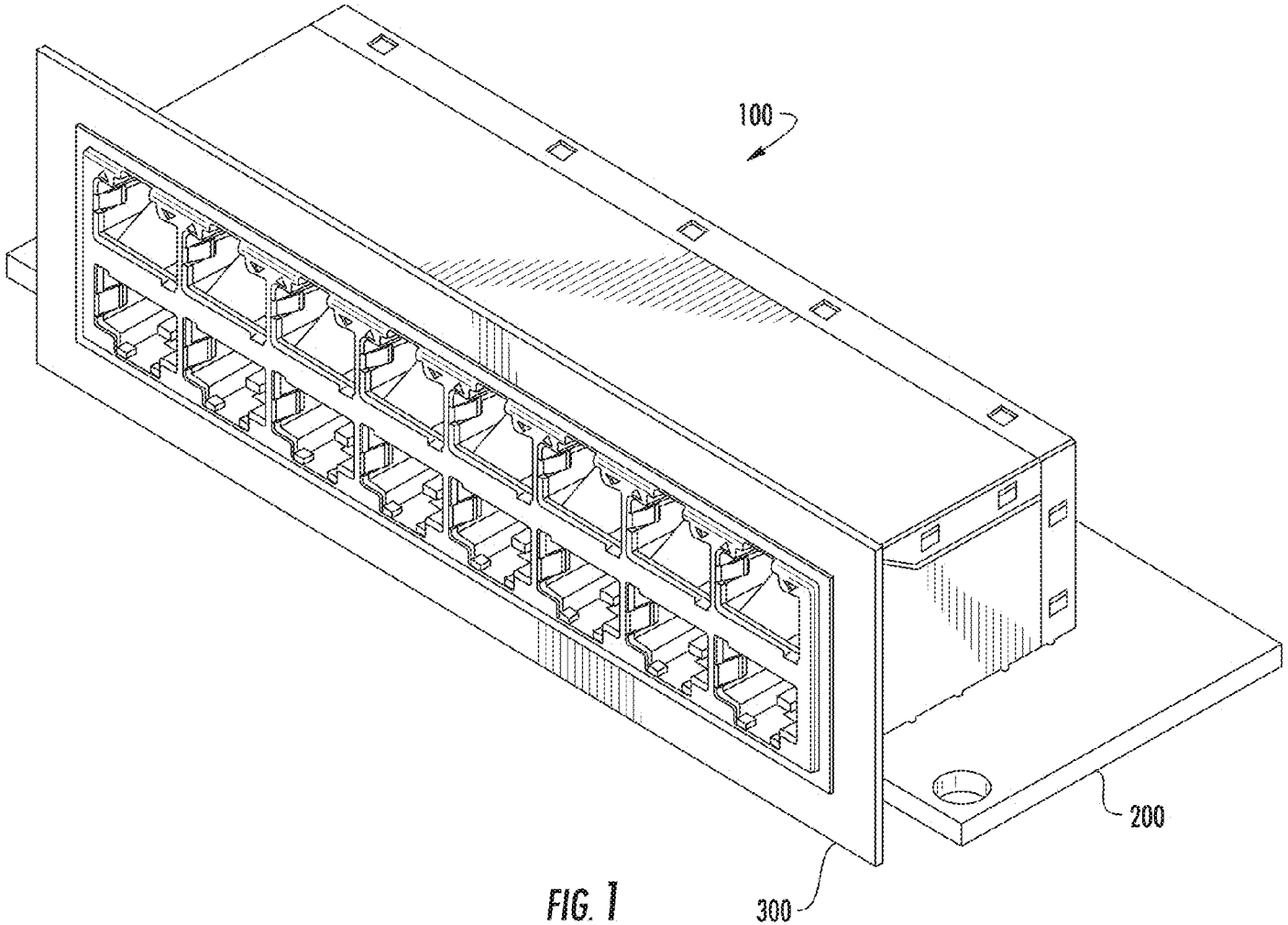
FIG. 1 is a perspective view of an exemplary integrated connector module (ICM) mounted onto a printed circuit board in accordance with one embodiment of the present disclosure.

All Figures disclosed herein are © Copyright 2011-2012 Pulse Electronics, Inc. All rights reserved.

DETAILED DESCRIPTION

Reference is now made to the drawings, wherein like numerals refer to like parts throughout.

As used herein, the terms "electrical component" and "electronic component" are used interchangeably and refer to components adapted to provide some electrical and/or signal conditioning function, including without limitation inductive reactors ("choke coils"), transformers, filters, transistors, gapped core toroids, inductors (coupled or otherwise), capacitors, resistors, operational amplifiers, processors, controllers, and diodes, whether discrete components or integrated circuits, whether alone or in combination.

As used herein, the term "integrated circuit" shall include any type of integrated device of any function, whether single or multiple die, or small or large scale of integration, including without limitation applications specific integrated circuits (ASICs), field programmable gate arrays (FPGAs), digital processors (e.g., DSPs, CISC microprocessors, or RISC processors), and so-called "system-on-a-chip" (SoC) devices.

As used herein, the term "magnetically permeable" refers to any number of materials commonly used for forming inductive cores or similar components, including without limitation various formulations made from ferrite.

As used herein, the term "signal conditioning" or "conditioning" shall be understood to include, but not be limited to, signal voltage transformation, filtering and noise mitigation, signal splitting, impedance control and correction, current limiting, capacitance control, and time delay.

As used herein, the terms "top", "bottom", "side", "up", "down" and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

Overview

The present disclosure provides, inter alia, a connector module having high electrical isolation, and methods for manufacturing and utilizing the same.

In one embodiment, an integrated connector module (ICM) is disclosed. The ICM includes a plurality of ports configured to receive modular plugs (such as e.g., the well known RJ-45 type plug), and an electromagnetic interference (EMI) collar that is positioned so as to be in contact with the ICM's body shield. The EMI collar is used to position an EMI gasket against the networking apparatus panel on which the ICM is ultimately mounted. The EMI collar is in the exemplary embodiment mounted onto the ICM in a manner such that additional processing techniques such as welding, soldering, etc. need not be utilized in order to secure the EMI collar to the body shield, as the EMI collar can be secured using a purely mechanical latching mechanism.

Modular plug grounding tabs are also included in some embodiments, and are configured to resiliently interface with respective grounding features on a modular plug. Furthermore, each port also includes a shielding tab that provides electrical connectivity between an internal printed circuit board and the body shield. An additional point of ground to the internal printed circuit board includes a rear grounding shield tab on the back shield that interfaces with the internal printed circuit board rear grounding pads on both sides (top and bottom) of the board.

Adjacent electronic subassemblies are further shielded in some embodiments through the use of an insert body shield. The insert body shield beneficially increases electrical isolation between adjacent subassemblies, thereby further mitigating possible electrical noise. The insert body shield is configured to be received within a slot formed within the connector housing. An internal shield is also included that is received in a slot of an insert body of the electronic sub-assemblies, thereby effectively shielding adjacent component-receiving cavities from one another.

In addition, improved methods and apparatus are disclosed which make use and take advantage of these shielded ICMs. For example, telecommunications/networking equipment that incorporate these ICMs are also disclosed.

Detailed Description of Exemplary Embodiments

Detailed descriptions of the various embodiments and variants of the apparatus and methods of the present disclosure are now provided. It will be appreciated that while exemplary embodiments of various aspects of the present disclosure are described primarily in terms of integrated connector modules (ICMs) having a plurality of jacks or ports for receiving RJ-style (e.g., RJ-45) modular plugs, the present disclosure is in no way limited to such applications, and in fact may be used consistent with any type of connector or connection apparatus where noise isolation and/or shielding is required.

Integrated Connector Modules—

Referring now to FIGS. 1-1L, an exemplary integrated connector module (ICM) 100 for use in a networking apparatus is shown and described in detail. Such a networking apparatus can include any number of well known devices including, for example, a networking switch, a networking router or a networking firewall. FIG. 1 illustrates the ICM mounted onto a networking apparatus printed circuit board 200. As will be described in more detail subsequently herein, the illustrated embodiment is mounted to the printed circuit board via a plurality of press-fit terminals. While the use of press-fit terminals is exemplary, it is appreciated that other interfaces to the printed circuit board, such as through-hole terminals similar to those described in co-owned U.S. Pat. No. 7,241,181 filed Jun. 28, 2005 and entitled "Universal connector assembly and method of manufacturing", the contents of which are incorporated herein by reference in its entirety, can be used as a substitute for the press-fit terminals illustrated. Furthermore, surface mount terminals could also be readily substituted in alternative embodiments.

FIG. 1 also illustrates the ICM interface relationship with an associated networking apparatus panel 300. Specifically, by interfacing the ICM with the networking apparatus panel, a common ground can be established between the ICM body shield 104 and the network apparatus panel.

Figure 1A:
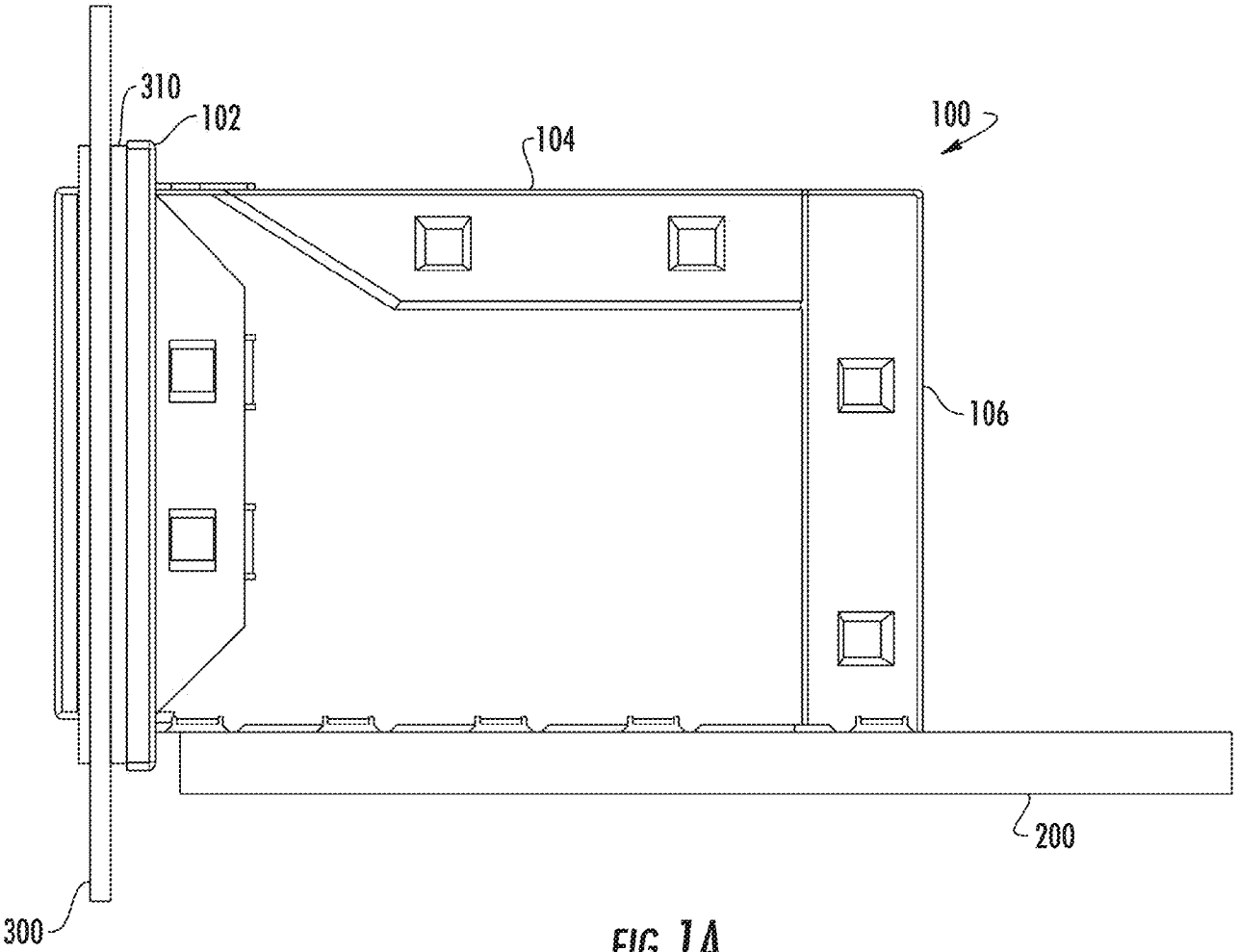
FIG. 1A is a side view illustrating the exemplary ICM mounted onto a circuit board as shown in FIG. 1.

FIG. 1A illustrates additional details of the exemplary ICM interface relationship with the networking apparatus panel 300. Specifically, FIG. 1A illustrates an electromagnetic interference (EMI) collar 102 that is positioned so as to be in contact with the ICM body shield 104. The EMI collar is used to position an EMI gasket 310 against the networking apparatus panel 300 and the ICM 100. Accordingly, the EMI collar in combination with the EMI gasket helps to provide a common ground between the ICM shield and the networking apparatus panel. In addition, tabs 105 located on the body shield 104 provide additional grounding contact to the back shield 106. Both the body shield and back shield are further coupled to a ground plane (not shown) on the networking apparatus printed circuit board 200. In this manner, a common ground is provided between the networking apparatus panel, ICM, and networking apparatus printed circuit board. It should be noted that while the use of an EMI collar and EMI gasket is exemplary, grounding tabs such as those used described in co-owned U.S. Pat. No. 6,962,511 filed Sep. 18, 2002 and entitled "Advanced microelectronic connector assembly and method of manufacturing", the contents of which are incorporated herein by reference in its entirety, may be used with equal success. Furthermore, it is appreciated that the use of these features may be obviated in some embodiments.

Figure 1B:
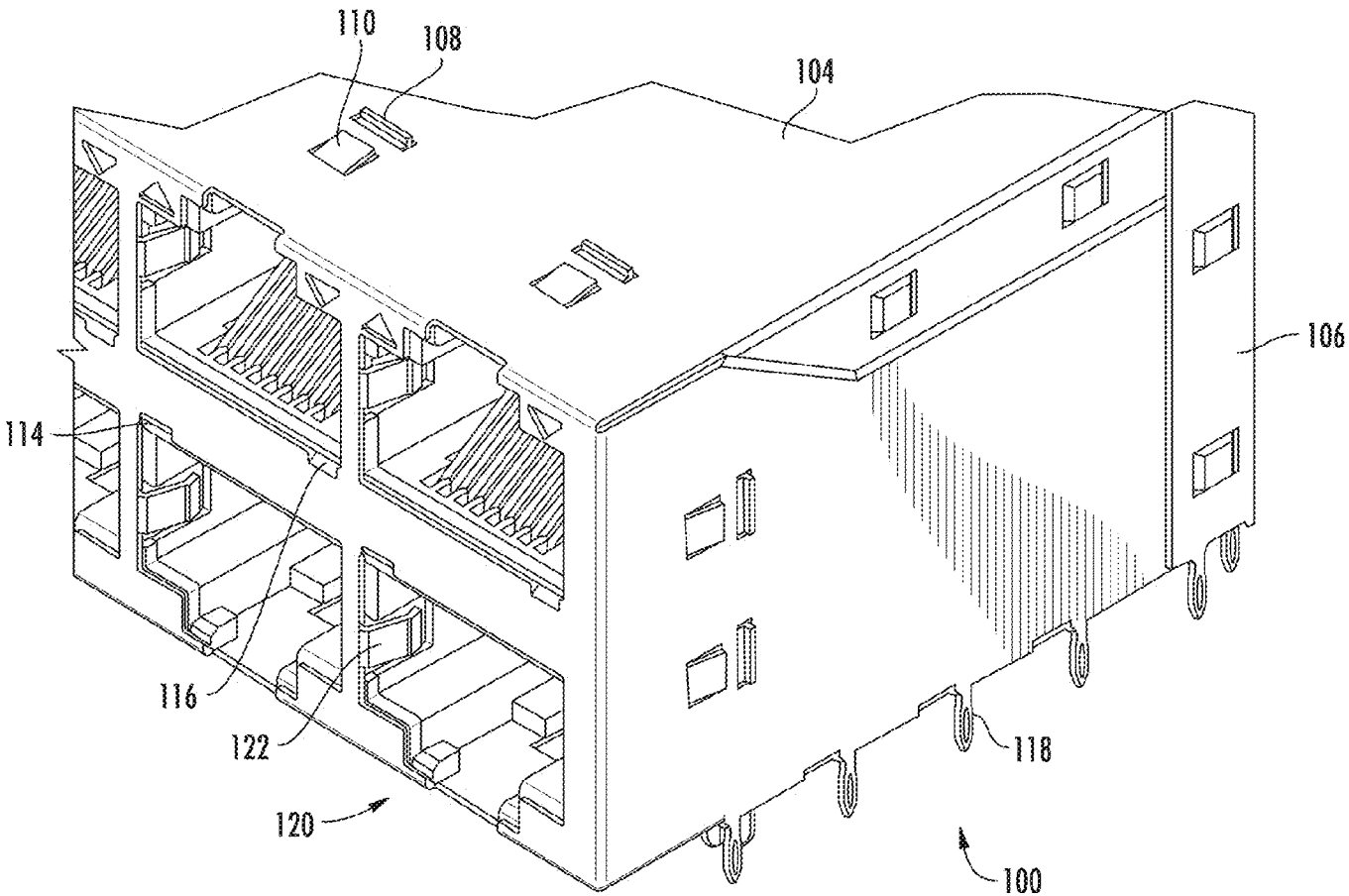
FIG. 1B is a detailed perspective view of the exemplary ICM of FIG. 1, illustrating various networking chassis apparatus grounding features in accordance with one embodiment of the present disclosure.

Referring now to FIG. 1B, a detailed view of a portion of the ICM 100 with the networking apparatus panel, EMI gasket and collar and networking apparatus printed circuit board removed from view is illustrated. Specifically, these various elements have been removed from view so that other features of the ICM are more readily visible. For example, the body shield 104 includes latch features 110 along with respective stops 108 which are used to secure the EMI collar to the body shield. The specific embodiment is exemplary from the perspective that no additional processing techniques such as welding, soldering, etc. need to be utilized in order to secure the EMI collar to the body shield, as the EMI collar can be secured using a purely mechanical latching mechanism. However, it will be appreciated that secondary processing techniques such as resistance welding, soldering, adhesives, etc. could be utilized in addition to, or instead of, a purely mechanical latching mechanism if desired in order to enhance the mechanical and/or electrical connection between the EMI collar and body shield in some embodiments.

Various other features which provide a path to ground for the ICM can also be seen. Press fit circuit board tines 118 formed on the body shield 104 and back shield 106 provide both mechanical support and electrical connectivity to plated through holes on, for example, the networking apparatus printed circuit board (FIG. 1A, 200). Each of the individual connector ports 120 also includes various features which offer additional paths to ground. Modular plug grounding tabs 122 are configured to resiliently interface with respective grounding features on a modular plug (not shown). Each port 120 also includes a shielding tab.

In the illustrated 2×N ICM configuration, the upper row of ports include a top row of front grounding shield tabs 116, while the bottom row of ports includes a bottom row of front grounding shield tabs 114. These front grounding shield tabs 114, 116 provide electrical connectivity between an internal printed circuit board and the body shield 104. While the illustrated embodiment shows a single front grounding shield tab 114 per port 102, it is appreciated that more or less front grounding shield tabs could be used. For example, two (2) front grounding shield tabs 114 could be utilized per port 102 in order to provide additional points for grounding the body shield to the internal printed circuit board 130. Alternatively, only the upper row of ports would contain a front grounding shield tab 114, while the lower row of ports will not contain any front grounding shield tabs. Accordingly, in such an embodiment the ICM will effectively half one-half (½) of a front grounding shield tab 114 per port. These and other variations would be readily apparent to one of ordinary skill given the present disclosure.

Figure 1C:
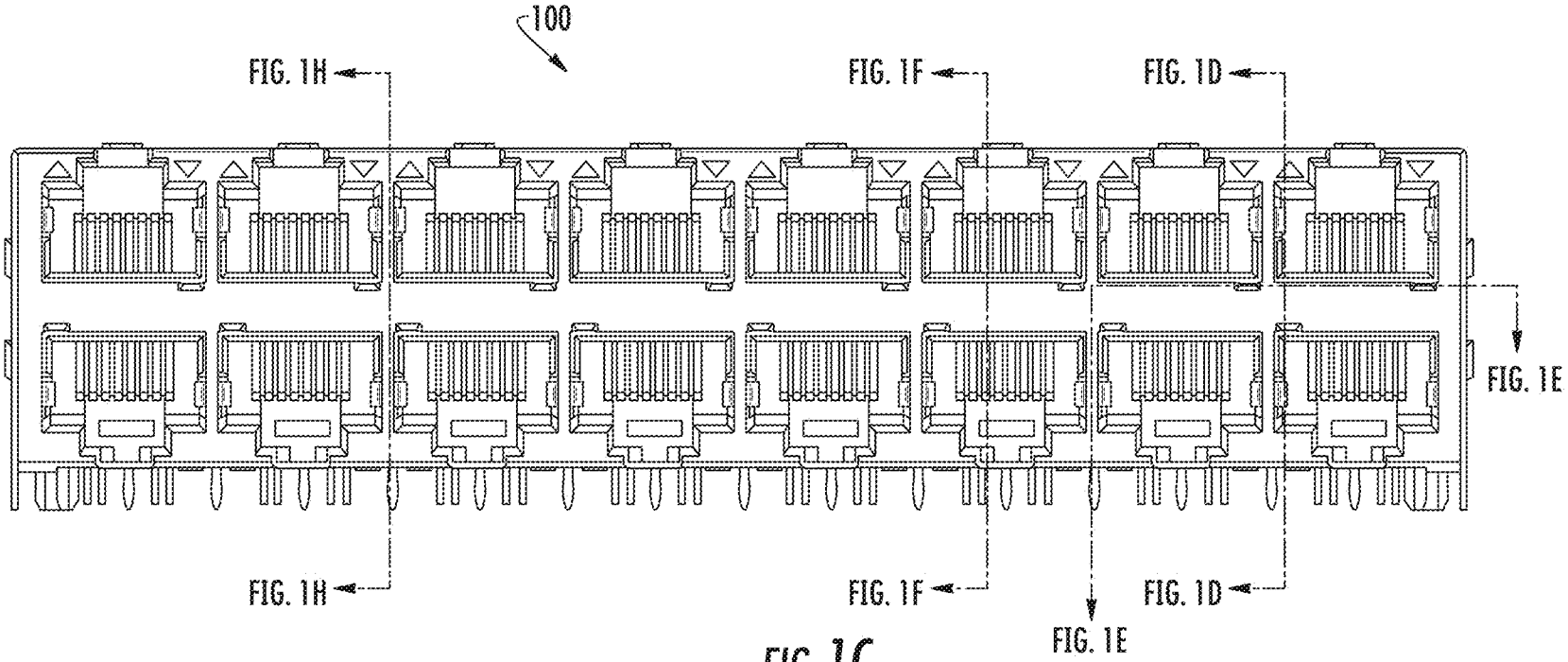
FIG. 1C is a front view of the exemplary ICM of FIG. 1.
Figure 1D:
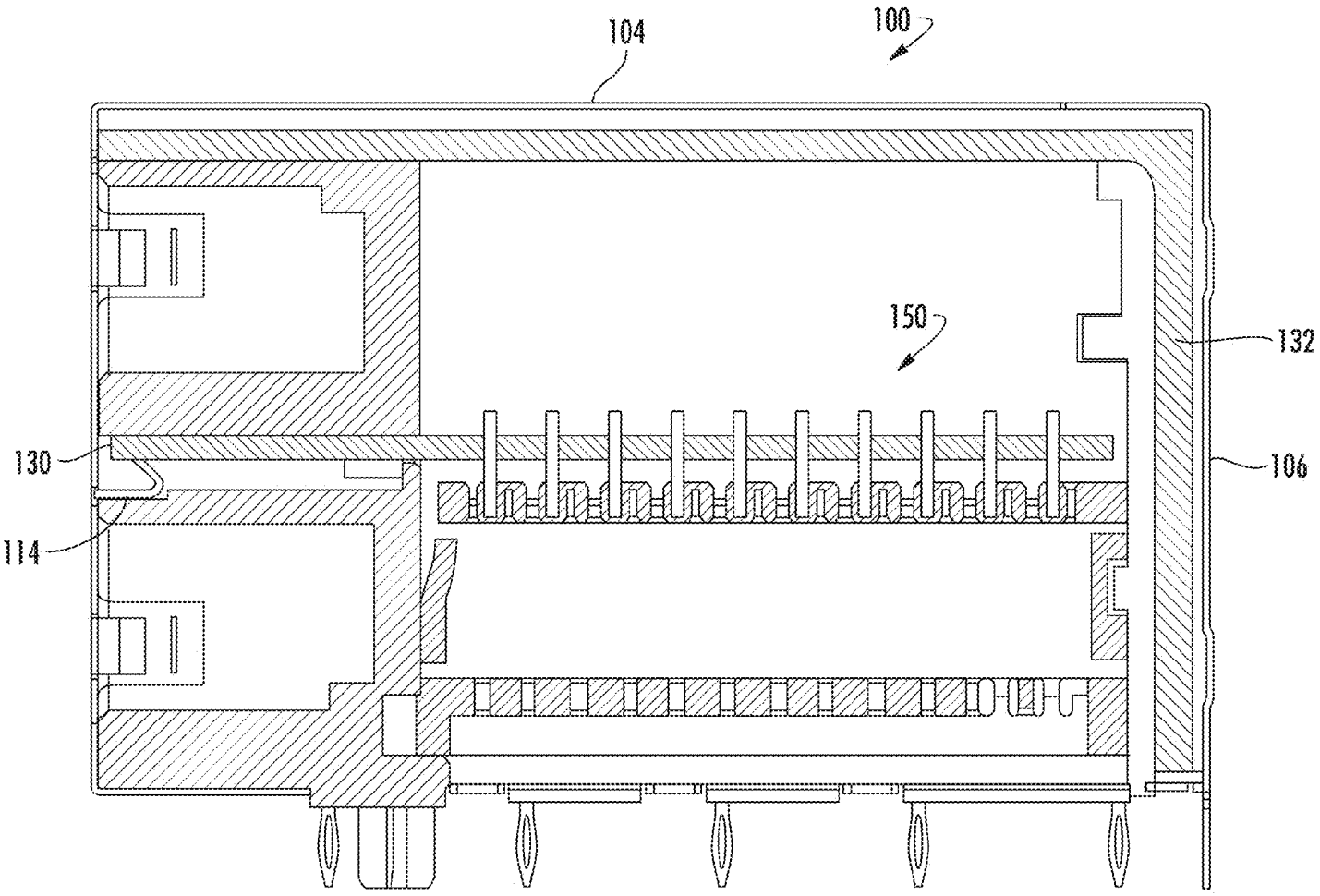
FIG. 1D is a cross-sectional side view of the exemplary ICM taken along lines 1D-1D in FIG. 1C, in accordance with one embodiment of the present disclosure.

Referring now to FIGS. 1C and 1D, the front grounding shield tabs 114 and their interface with the internal printed circuit board 130 is more readily visible. Specifically, the cross-sectional view illustrated in FIG. 1D shows the electronics subassembly 150 within the connector housing 134 with light pipes 132. The electronics subassembly 150 includes the internal printed circuit board 130 which contains grounding pads which interface with the front grounding shield tab 114. The front grounding shield tab 114 is in the illustrated embodiment shaped so that it acts like a spring when the electronics subassembly is mounted into the connector housing 132. In the illustrated cross-sectional view of FIG. 1D, the front grounding shield tab 114 is deflected as the electronics subassembly 150 is inserted into the housing. The front grounding shield tab 114 is then in electrical communication with a ground pad located on the underside of the internal printed circuit board 130. Similarly, the upper front grounding shield tabs (116, FIG. 1B) interface with a ground pad located on the upper surface of the internal printed circuit board 130 in a similar fashion; i.e., the upper front grounding shield tabs are shaped so as to act like a spring when the electronics subassembly is mounted into the connector housing.

Figure 1E:
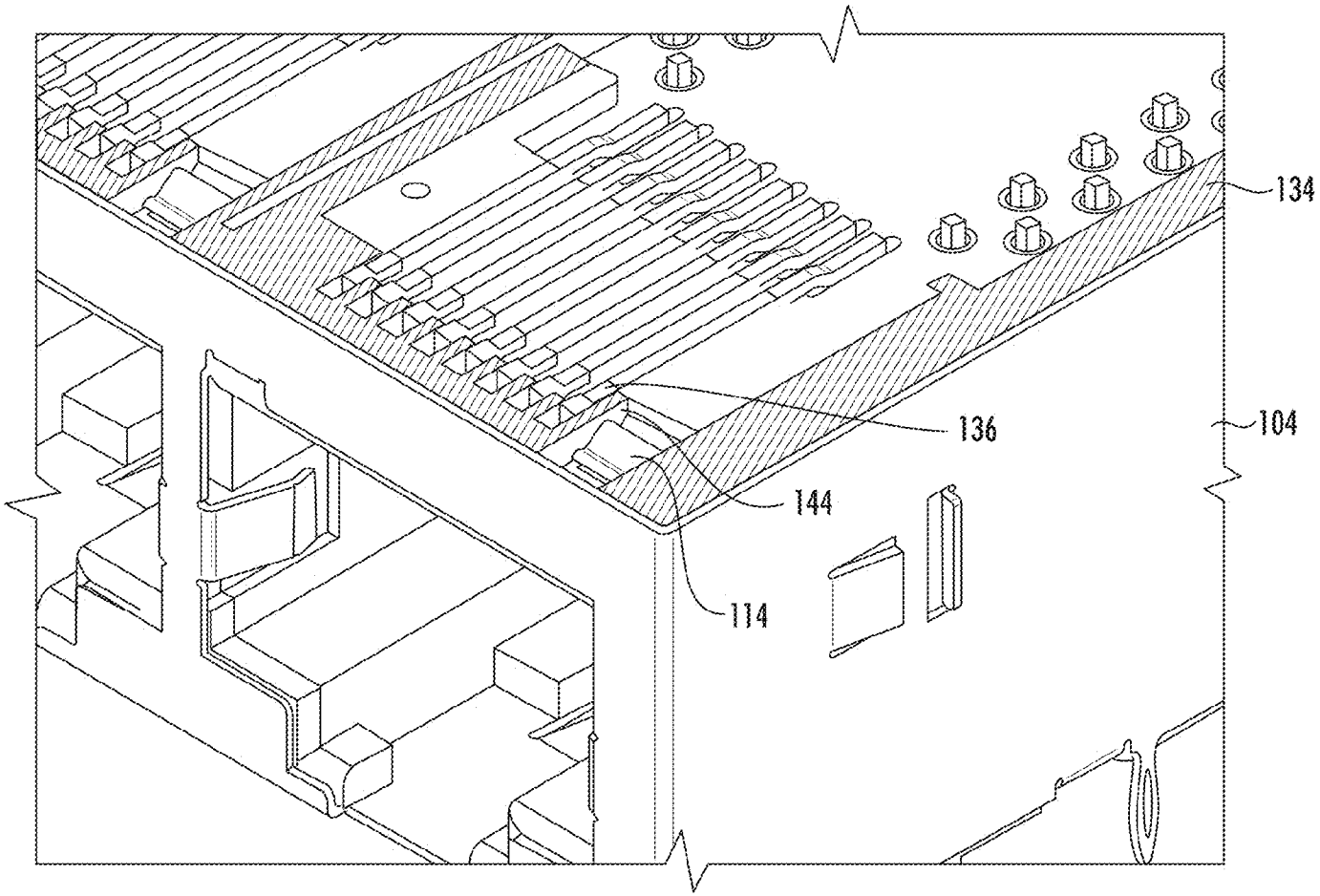
FIG. 1E is a cross-sectional perspective view of the exemplary ICM taken along lines 1E-1E in FIG. 1C in accordance with one embodiment of the present disclosure.

Referring now to FIG. 1E, a detailed cross-sectional view of the housing illustrating the relationship between the insert assembly containing the conductors 136 and the front grounding shield tab 114 of the main body shield 104 is shown. Due to the close proximity of the front grounding shield tab and the conductors, there is a potential problem of insufficient isolation between the shield tab and the conductors. Accordingly, a lack of sufficient insulation between a ground and a voltage carrying conductor can result in unwanted leakage current between them. This leakage current is of particular importance in regards to electrical surge events (e.g., a lightning strike or other voltage-inducing transient on the line) which can generate high leakage currents, thereby resulting in component damage. In addition, electrical surge events can also present a shock hazard to persons in contact with the device. The illustrated embodiment of FIG. 1E addresses this issue by forming the housing 134 with a wall structure 144 that separates the front grounding shield tab 114 and the conductors 136. A similar wall structure is also utilized with the opposing front grounding shield tab 116. The wall structure serves as a high-potential barrier, thereby mitigating possible leakage current between the shield tab (ground) and the conductors 136. While the wall structure 144 of the presently illustrated embodiment is formed as part of the housing, the present disclosure is not so limited. In alternative implementations, the wall structure may be part of the terminal insert assembly (152, FIG. 1I) or may comprise a separate component altogether.

Figure 1F:
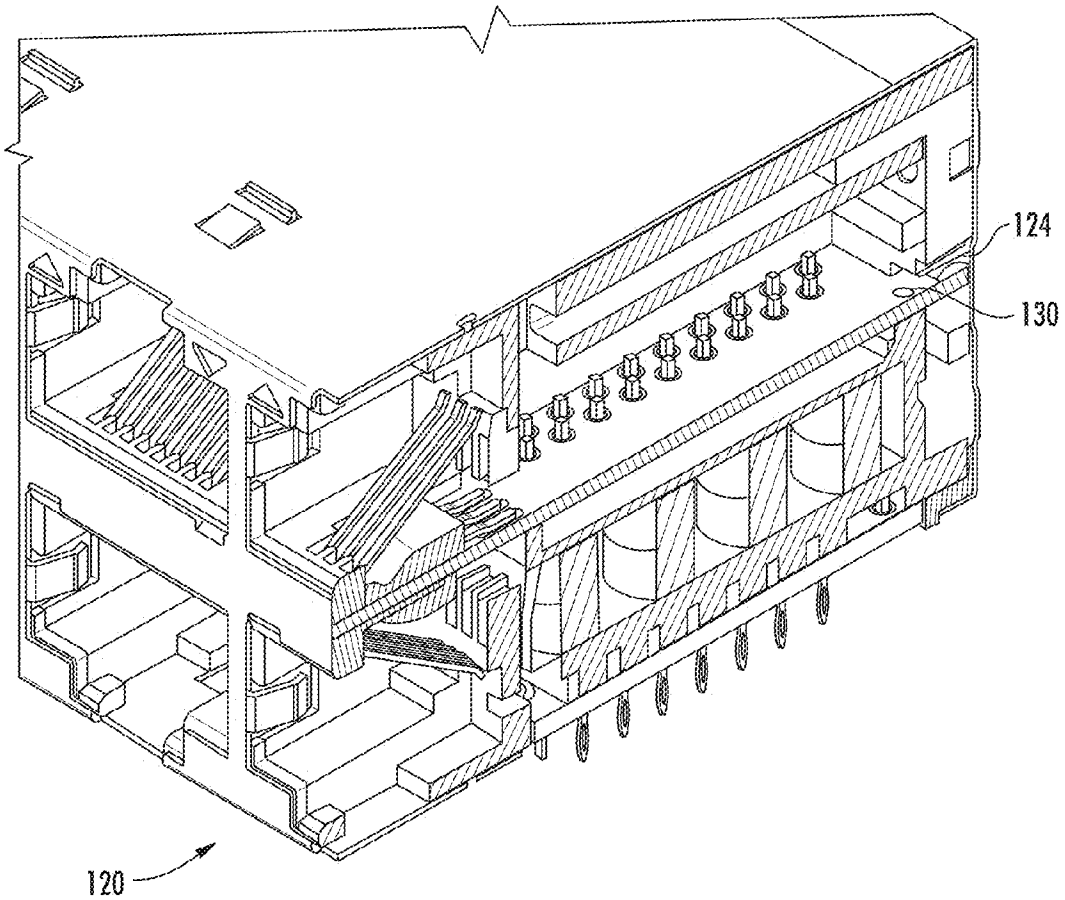
FIG. 1F is a cross-sectional perspective view of the exemplary ICM taken along lines 1F-1F in FIG. 1C in accordance with one embodiment of the present disclosure.

Referring now to FIG. 1F, an exemplary configuration of an additional point of ground to the internal printed circuit board 130 is illustrated. More specifically, the rear grounding shield tab 124 of the back shield 106 and its interface with the internal printed circuit board 130 is more clearly shown. FIG. 1F illustrates a cross-sectional view of an electronics subassembly 150 and its respective ports 120 within the ICM 100. In the illustrated embodiment, the rear grounding tab 124 is formed from the back shield 106 so that when the rear shield is installed onto the ICM 100, the rear grounding tab 124 is secured against the internal printed circuit board 130 with a mechanical retentive force. The internal printed circuit board 130 comprises rear grounding pads on both sides (top and bottom) of the board 130, and form an electrical connection with the rear grounding tabs 124. While the present illustration only provides a single rear grounding tab 124 per electronics subassembly, it is appreciated that any number of rear grounding tabs 124 could be implemented in the present disclosure. For example, instead of including a single rear grounding pad in the center portion of the internal printed circuit board, two rear grounding pads could be incorporated onto respective corners of the board.

Furthermore, it is appreciated that in embodiments in which multiple rear grounding tabs are utilized per electronics subassembly, one or more of the rear grounding tabs can interface the top of the board 130 (as shown), with additional grounding tab(s) interfacing with the underside of the board 130.

Figure 1G:
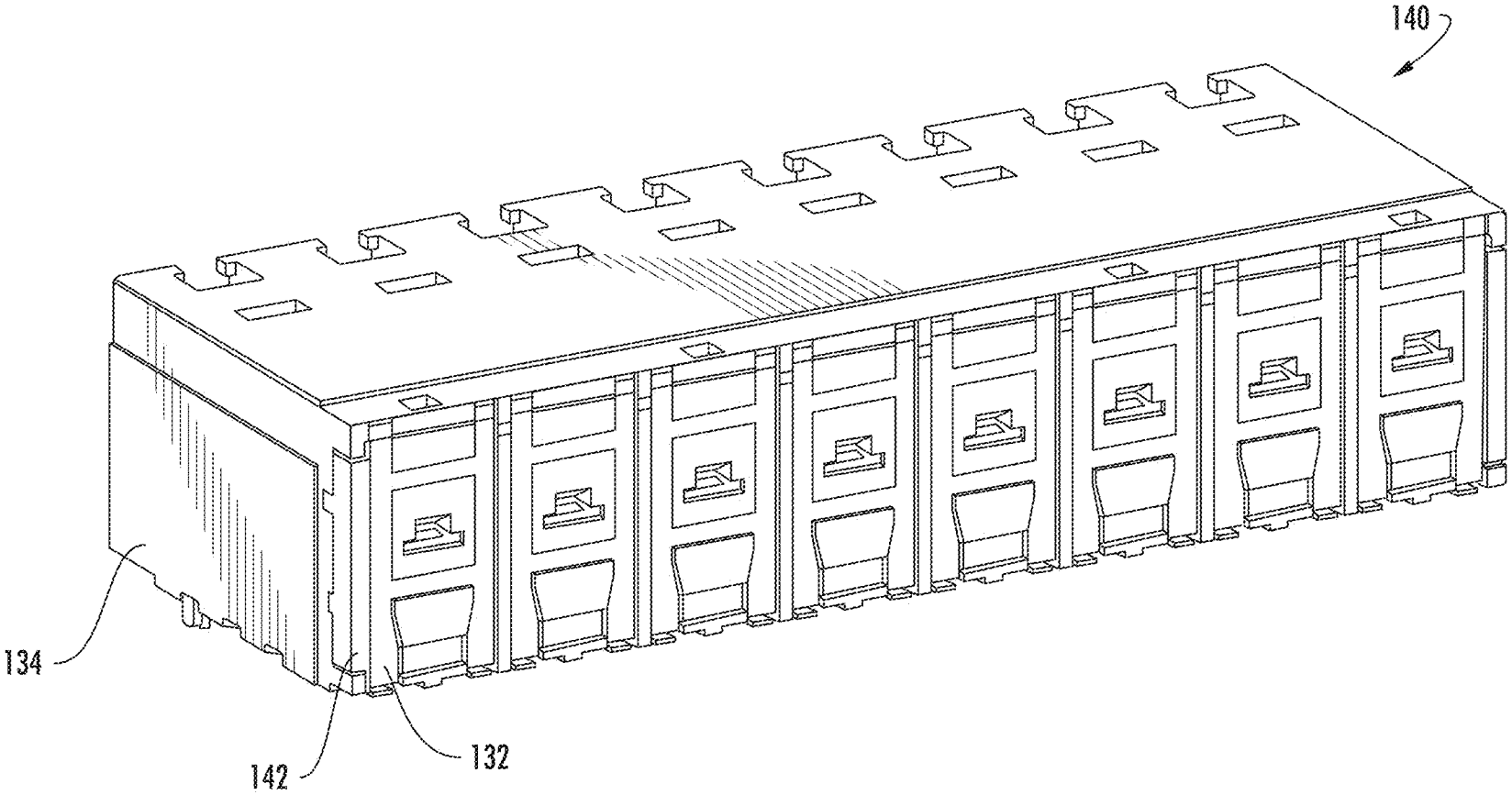
FIG. 1G is a perspective view showing the back side of the exemplary ICM illustrated in FIG. 1 in accordance with one embodiment of the present disclosure.

Referring now to FIG. 1G, a rear view of an exemplary connector housing assembly 140 (before the body shield 104 and the rear shield 106 are installed) is shown. The connector housing assembly 140 includes the connector housing 134, which is adapted to receive electronics subassemblies 150. The connector housing 134 is further adapted to interface with a rear housing 142. The rear housing 142 beneficially helps retained the installed electronics subassemblies 150 within the connector housing 134. In addition, the rear housing 142 provides additional structural support to the connector housing assembly 140. The connector housing 134 and rear housing 142 are further configured to receive light pipes 132, although use of light pipes or other indication mechanisms is by no means a requirement of practicing the present disclosure. Moreover, while the exemplary embodiment of the connection housing assembly 140 illustrates that the light pipes are installed before the body shield 104 and back shield 106, the present disclosure is not so limited. Alternatively the connector housing assembly can be configured such that one can install or remove the light pipes 132 without having to remove the body shield 104 and/or the back shield 106. For example, the light pipe assemblies and external noise shield may be configured so as to be removable or installable with the back shield installed as described in U.S. Pat. No. 6,962,511 to Gutierrez, et al. entitled "Advanced Microelectronic Connector Assembly And Method Of Manufacturing", the contents of which are herein incorporated by reference in its entirety.

Figure 1H:
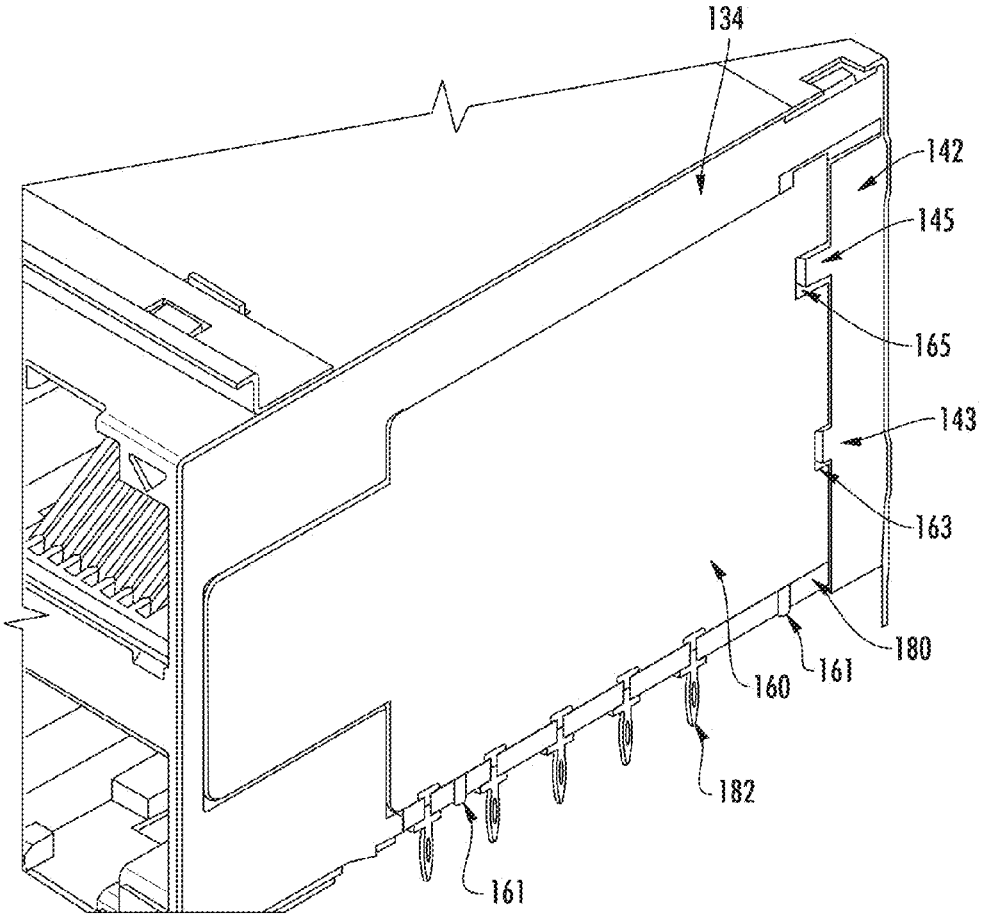
FIG. 1H is a cross-sectional perspective view of the exemplary ICM taken along lines 1H-1H in FIG. 1C in accordance with one embodiment of the present disclosure.
Figure 11:
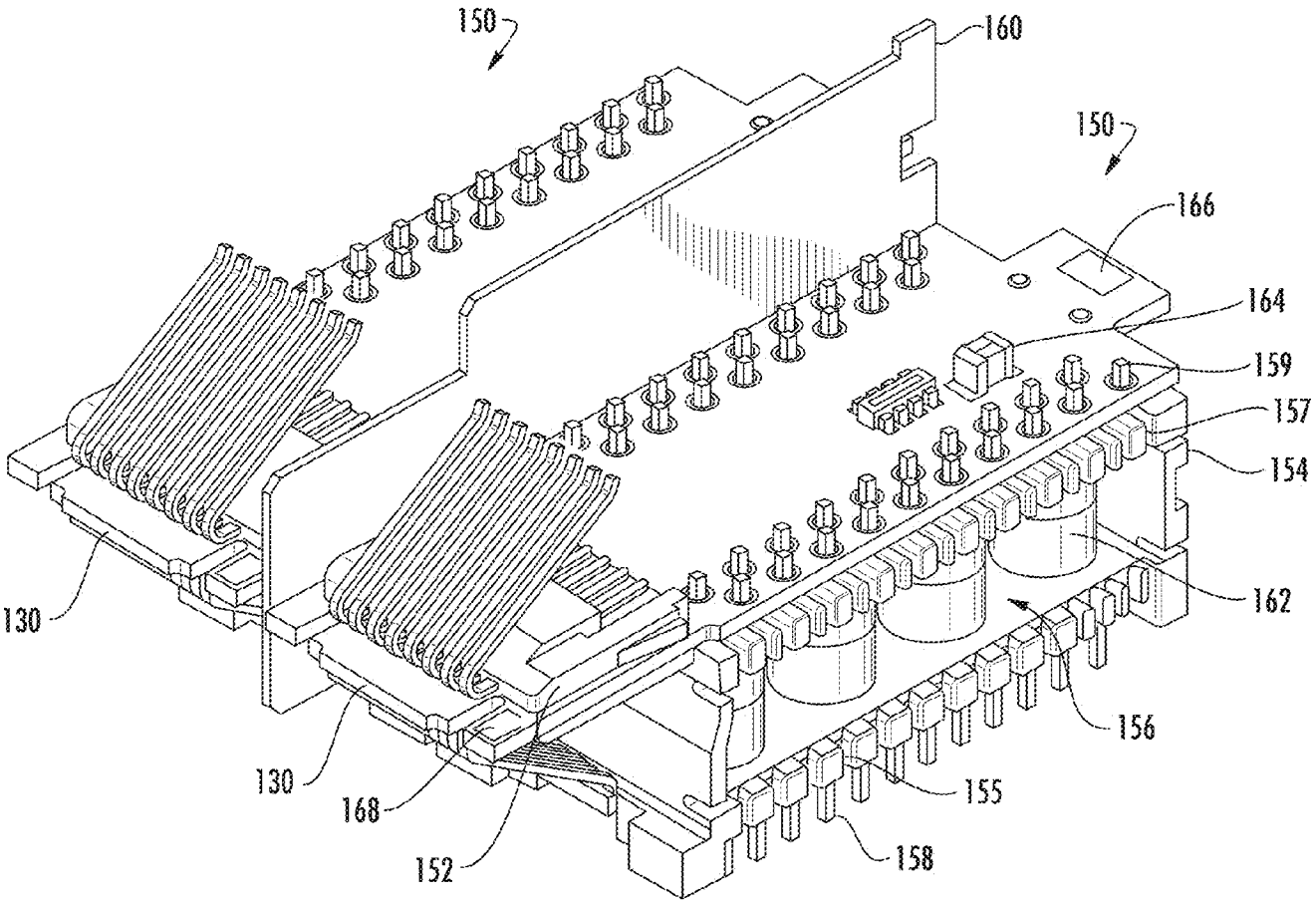

Referring now to FIG. 1H, a cross-sectional view illustrating various features that enable the use of press-fit contacts 182 are shown and described in detail. Specifically, the ICM illustrated includes a relatively large number of press-fit contacts (see, for example, FIG. 1L discussed below). As a result of this relatively large number of press-fit contacts, the underlying housing 134 experiences a significant amount of stress when the ICM is press-fit onto the customer's printed circuit board. In the illustrated embodiment, extra structural support is provided to the ICM via its inclusion of insert body shields 160. In the exemplary embodiment, the insert body shield 160 is positioned between adjacent electronics subassemblies 150, and incorporated into the housing 134 as a panel that is used both for: (1) providing electrical shielding between adjacent columns of ports; and as (2) a mechanical support for the entire ICM assembly as these insert body shields are supported at both the top of the housing 134 and the lower substrate 180. In the illustrated embodiment, the rear housing 142 also provides structural rigidity to the ICM via its inclusion of integrated support features 143, 145 which interface with features 163, 165, respectively, located on the insert body shields 160. Exemplary embodiments of the insert body shield 160 also incorporate grounding pins 161 to provide additional grounding locations between the insert body shield and the lower substrate (180, FIG. 1L) and/or an external substrate (200, FIG. 1). Additionally, in an exemplary embodiment, grounding pins (not shown) are also incorporated into the insert body shield to as to provide grounding locations to the main shield body (104, FIG. 1A) and/or the back shield (106, FIG. 1A).

FIG. 1I illustrates a detailed view of adjacent electronic subassemblies 150, which are shielded through the use of an insert body shield 160. The insert body shield 160 beneficially increases electrical noise isolation between subassemblies 150, thereby further mitigating possible electrical noise interface between adjacent individual subassemblies. Accordingly, the insert body shield is separately received within the housing in a processing step unrelated to the insertion of the electronic subassemblies 150. In an alternative embodiment, the insert body shield is insert-molded into the housing such that it is physically integrated into the connector housing when the connector housing is formed. As yet another alternative, the insert body shield(s) may be part of the connector insert assemblies themselves. The subassemblies 150 illustrated in FIG. 1I each include a molded insert body 154, which is in an exemplary embodiment, made of a unitary construction. The electronic subassemblies 150 are configured to receive one or more types of electronic components 162 within the interior cavity 156 formed within each insert body 154, including e.g., choke coils, transformers, etc. These components have their wires in electrical communication with one or more of the upper and lower terminals 159, 158 of the assembly 150, such as via wire-wrapping, soldering, welding, or the like. A plurality of upper and lower wire channels 155, 157, respectively, are also provided to aid in wire routing and separation. These wire channels also prevent damage to the routed wires when the subassembly 150 is inserted into the housing. The terminals 158, 159 may also be notched as is well known in the art to further facilitate bonding of the wires thereto. The electronic components may also be encapsulated within a potting compound or encapsulant such as epoxy or silicone gel if desired.

The internal printed circuit board 130 includes a plurality of apertures configured to receive the upper terminals 159 of the insert body 154, and may be populated on one of both surfaces with any manner of electronic components 164 (whether discrete components such as resistors, capacitors, etc. or integrated circuits), conductive traces, etc. The exemplary internal printed circuit board 130 of FIG. 1I also includes a series (e.g. eight) conductive traces (not shown) disposed on both upper and lower surfaces thereof so as to cooperate with the plurality of conductors disposed within the terminal insert assemblies 152. The internal printed circuit board 130 further includes front grounding pad(s) 168 and rear grounding pad(s) 166, which are intended to interface with the front shield grounding tab 114 and the rear shield grounding tab 124, respectively, discussed previously herein. The internal printed circuit board also optionally includes a grounding layer disposed between the top and bottom surfaces of the printed circuit board in order to provide additional electrical noise isolation between circuitry on the top surface and the bottom surface of the internal printed circuit board.

Figure 1J:
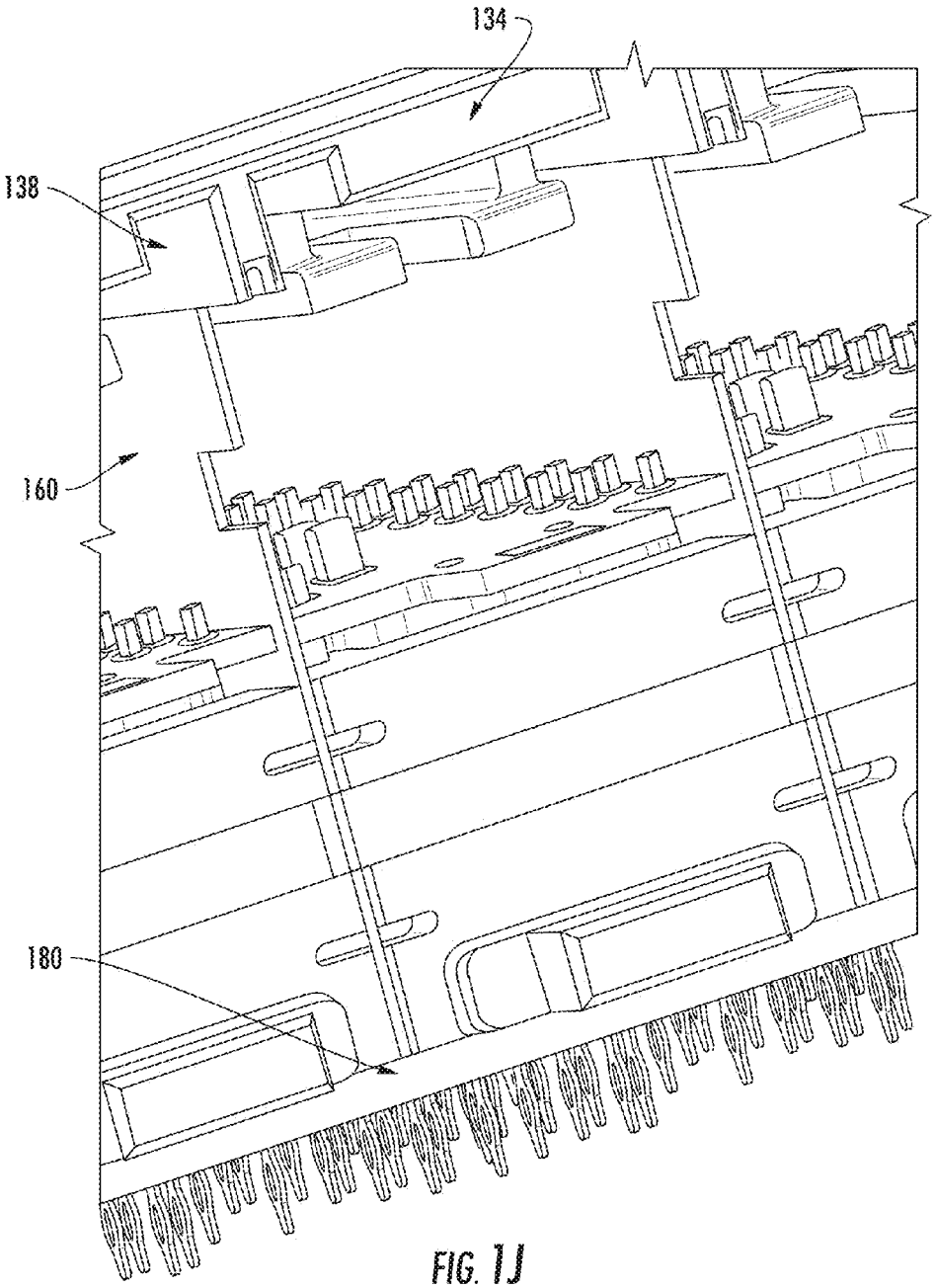
FIG. 1J is a perspective view of the back side of an electronic subassembly for use in the ICM illustrated in FIG. 1 in accordance with one embodiment of the present disclosure.

Referring now to FIG. 1J, a rear view of adjacent electronic subassemblies 150 installed into the connector 134 is illustrated. Note that this view is illustrative of the connector assembly prior to installation of the rear shield 106 and rear housing 142. As shown, and as discussed previously, adjacent columns of ports are separated by the insert body shield 160 thereby effectively shielding the adjacent electronic subassemblies 150 from one another. Furthermore, the insert body shield is, in the illustrated embodiment, configured to be received within a support feature 138 with an associated slot formed within the connector housing 134. The insert body shield is also supported by the lower substrate 180 at the lower portion of the insert body shield. Such a configuration enables the insert body shield to act as a supportive beam which supports the top portion of the housing during press-fit installation of the integrated connector module.

Figure 1K:
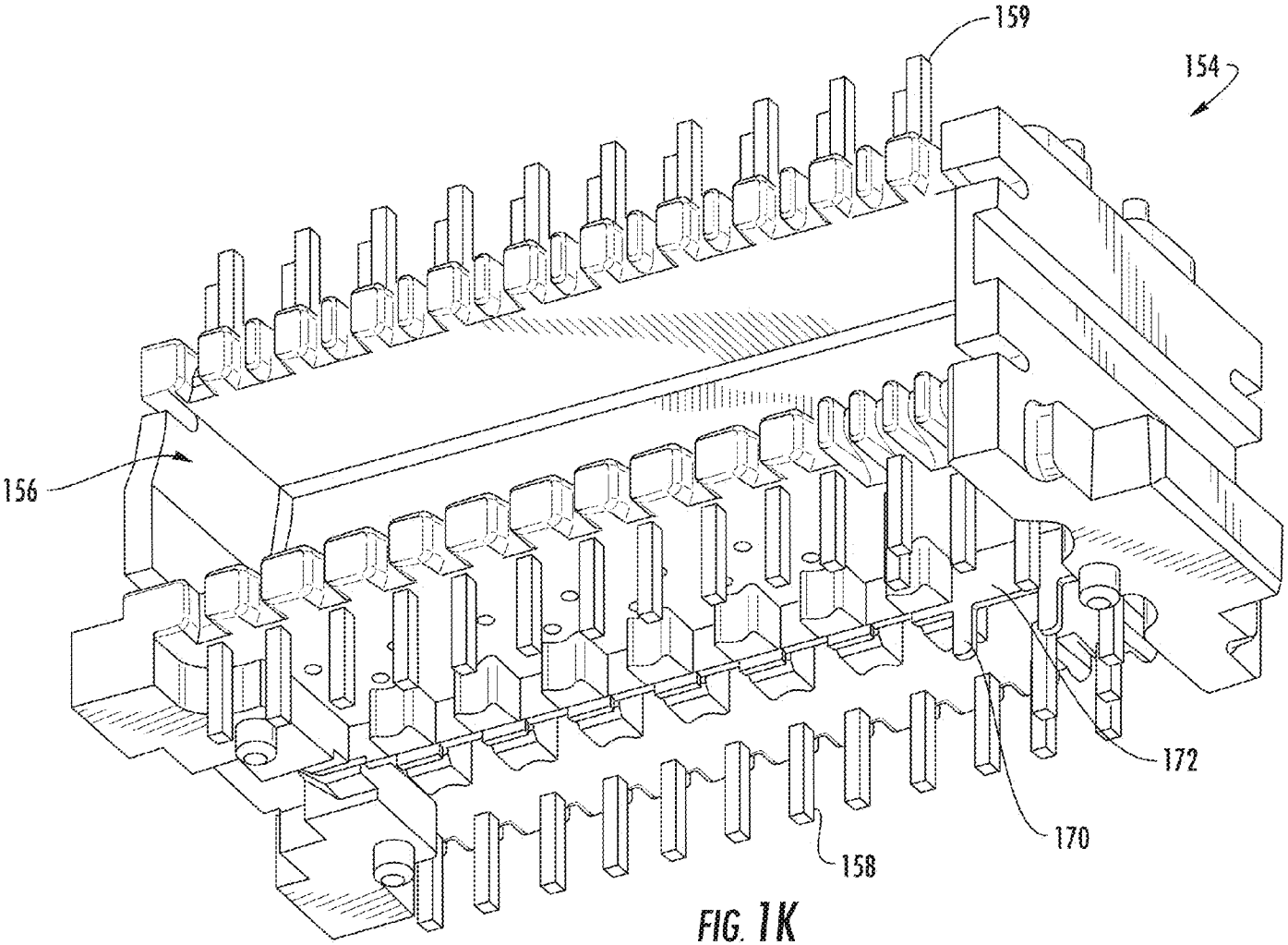
FIG. 1K is a perspective view of the underside of an insert body with associated insert body shield for use in the electronic subassemblies illustrated in FIG. 1I.
Figure 11:
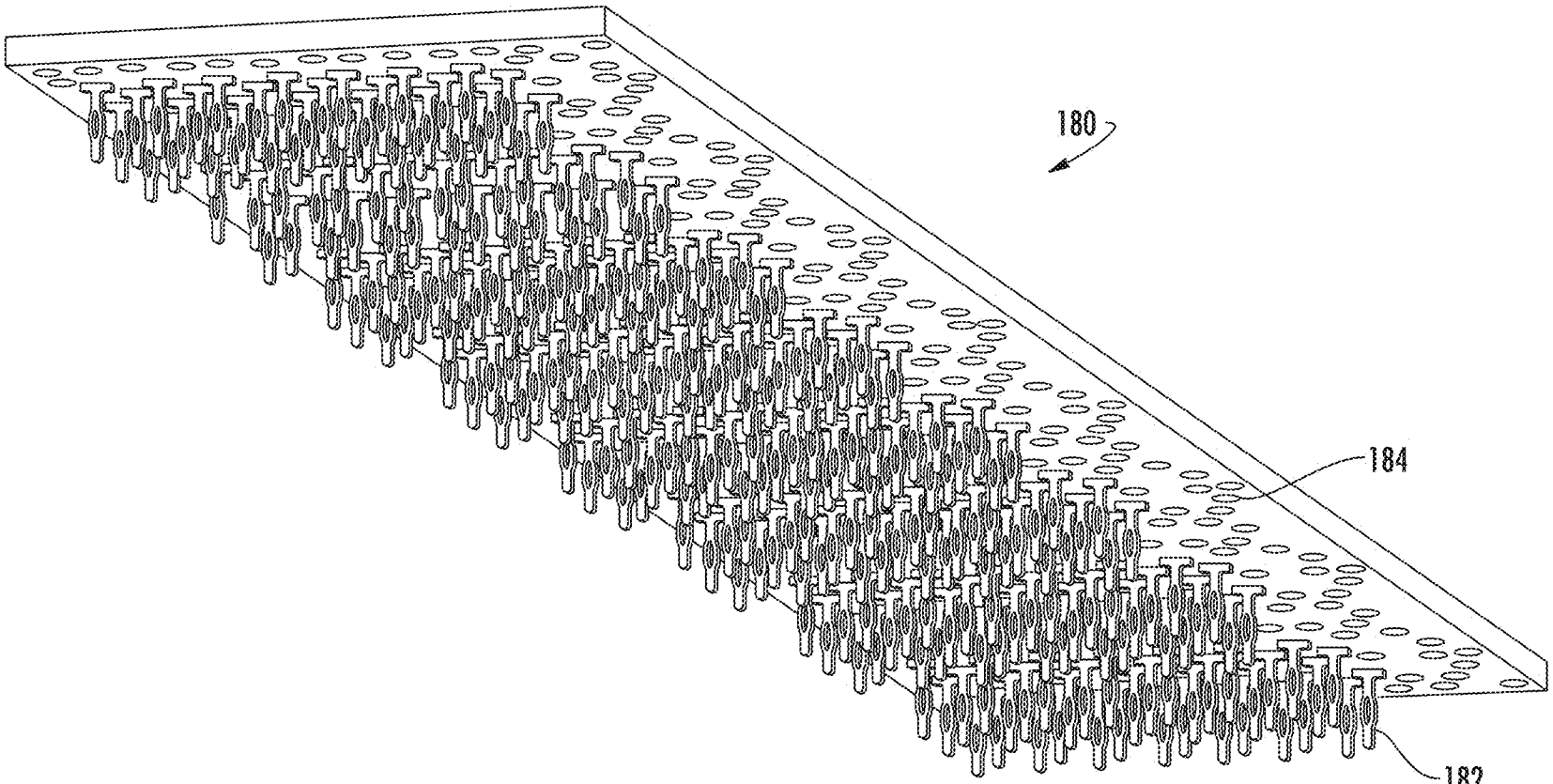

Referring now to FIG. 1K, one embodiment of the insert body 154 with an incorporated internal shield 172 is illustrated. As previously discussed, in the exemplary illustration, the insert body 154 is formed to include a plurality of lower and upper terminals 158, 159, as well as a component receiving cavity 156 on opposing sides of the insert body. As a brief aside, the insert body 154 houses the electronic circuitry for both the respective upper and lower ports 159, 158 in each of these component receiving cavities, respectively. Accordingly, as these two circuits for adjacent ports are in close proximity to one another within a single insert body, the two separate circuits may cause interference with each other to some degree. In applications requiring increased levels of electromagnetic isolation (e.g., very high-speed data applications such as 10 Gigabits/s or colloquially "10G"), this electrical interference may degrade the performance of the device to unacceptable levels. The exemplary insert body 154 is configured with a slot disposed proximately center of the insert body 154 and extending from the front-to-rear face of the insert body 154. An internal shield 172 is received in the slot, thereby effectively shielding the adjacent component receiving cavities 156 from one another. Alternatively, the internal shield can be insert-molded as part of the insert body when the insert body is manufactured. Through the use of this internal shield, the electronic circuitry for the respective upper and lower ports can be disposed within each of the separate cavities, and be isolated from one another, thereby mitigating electrical interference between them.

The internal shield 172 further comprises grounding pins 170 to interface with a lower substrate aperture (180, FIG. 1I) and provides an additional connection to ground. Note while two grounding pins 170 are illustrated, any number of grounding pins may be implemented depending on application need. Furthermore, in alternative variants, the grounding pins may be extended so as to interface with the networking apparatus printed circuit board.

While the exemplary internal shield 172 is oriented extending completely from the front to rear of the middle of the insert body, the present disclosure is not limited. Any number of orientations and internal shield 172 configurations can be implemented. For example, the internal shield 172 may extend from the left to right side of the insert body 154, be disposed at any part of the insert body 154, or extend partly within the insert body 154.

Referring now to FIG. 1L, an exemplary embodiment of the lower substrate 180 is described in detail. The lower substrate 180 comprises, in the illustrated embodiment, at least one layer of fiberglass, although other arrangements and materials may be used. The substrate 180 further includes a plurality of conductor perforation arrays 184 formed at predetermined located on the substrate 180 with respected to the lower terminals 158 of each electronics subassembly 150, such that when the connector assembly 100 is fully assembled, the conductors 158 penetrate the substrate via respective ones of the aperture arrays 184. This arrangement advantageously provides mechanical stability and registration for the lower terminals 158. The lower substrate further comprises a plurality of press-fit contacts 182 extending from the bottom surface of the substrate. The press-fit contacts 182 interface with respective apertures (not shown) in the lower substrate 180. The apertures associated with the press-fit contact are configured to be in electrical contact with the aperture arrays 184 via, for example, conductive traces resident on the lower substrate 180. Thus, the orientation of the press-fit contacts 182, which ultimately mount to an external substrate or device, can be made independent of the orientation formed by the plurality of electronic subassemblies and their respective lower terminals 158. In addition, the lower substrate 180 may be configured to offer additional EMI shielding. For example, the multi-dimensional shielding apparatus and techniques described in U.S. Pat. No. 6,585,540 to Gutierrez, et al. issued Jul. 1, 2003 entitled "Shielded Microelectronic Connector Assembly And Method Of Manufacturing" and incorporated herein by reference in its entirety, may be used consistent with the present disclosure, with adaptation well within the skill of the ordinary artisan when given this disclosure. Other shielding configurations may also be used, the foregoing being but one option. Furthermore, other techniques well known in the electronic arts for minimizing EMI and/or cross-talk may be used consistent with the present disclosure if desired.

In addition, while the illustrated lower substrate 180 is shown with a unitary construction, the lower substrate may comprise multiple lower substrates configured to mate with any number of electronic subassemblies 150. For example, each lower substrate 180 can be configured to utilize application-specific electronic subassemblies such as those described in U.S. Pat. No. 7,241,181 to Machado, et al. issued Jul. 10, 2007 entitled "Universal Connector Assembly And Method Of Manufacturing" and incorporated herein by reference in its entirety, consistent with the present disclosure.

10GBase-T Magnetics—

Prior art 10/100/1000Base-T physical links required the use of magnetics with a minimum bandwidth of about 125 MHz, and with a specified return loss performance up to about 100 MHz. More recently in 10GBase-T application, the signal energy spectrum for the physical link extends to 400 MHz, and therefore, requires a wider bandwidth, to at least above 500 MHz. Accordingly, the 10GBase-T magnetics used within the insert body (154, FIG. 1K) in an exemplary embodiment require specialized winding methodologies in order to meet 10G physical layer (PHY) supplier specifications. Even though the basic requirement for 10GBase-T magnetics is a wider operating bandwidth, return loss has always been the most critical and most difficult to achieve parameter that is specified by 10G PHY suppliers. These return loss requirements require exceptional performance over the operating frequency range from 1 MHz to 500 MHz with several PHY suppliers defining the return loss specification up to 800 MHz.

For prior art 10/100/1000 magnetics, transformers are typically wound with a quadfilar (4-wire strand) twisted magnet wire with wire gauges ranging from AWG38 to AWG40. Common-mode chokes are wound using the wires from the transformers in a daisy chained fashion. This winding technique yields a bandwidth of about 200 MHz-250 MHz in prior art 10/100/1000 magnetics. In order to improve the bandwidth and return loss performance in 10G applications, an octa-filar winding (i.e. 8-wire strand) is used instead of a quadfilar winding. This octa-filar winding technique is used to split the current through each winding so as to improve magnetic and capacitive couplings between each of the windings. In addition to using octa-filar windings on the transformer in order to improve magnetic coupling, the common-mode choke is in an exemplary embodiment wound using forty (40) gauge HEX wires, which have the equivalent resin coating thickness of six times that of a single coated wire (i.e. SPN). This winding method improves the bandwidth to above 500 MHz on average. However, since the increased coupling varies randomly because of the random distribution of wires in the 8-wire bundle, the variation in performance from can be quite large from magnetic to magnetic. Furthermore, in many cases the bandwidth can go below the specified lower bound limit of 500 MHz.

In order to improve the coupling between the primary and secondary side of the transformer and hence improve the consistency in performance of the magnetics, the octa-filar bundle used in the transformers is split into two groups of four wires. Each quad-filar bundle is twisted tightly by a wire twisting machine that controls the wire order in the bundle. The wire order is set such that the primary windings are always sandwiched between the secondary windings, and vice versa. This results in the most consistent coupling between the two sides of the transformer. The use of such "woven" winding techniques is also described in co-owned U.S. patent application Ser. No. 13/033,523 filed Feb. 23, 2011 and entitled "Woven Wire, Inductive Devices, and Methods of Manufacturing", now issued as U.S. Pat. No. 8,405,481 on Mar. 26, 2013, the contents of which are incorporated herein by reference in its entirety. Additionally, to conform to some PHY supplier's requirement of an 180 uH minimum parallel inductance (OCL), a new, slightly larger core is used, with dimensions optimized to have a small inside diameter (ID) in order to help retain good/consistent coupling between the windings. The common-mode choke is also adjusted by optimizing the number of twists per unit length, and number of turns, to provide the best impedance matching possible with as little degradation on common-mode rejection performance as possible. The result of these manufacturing techniques is a bandwidth that is consistently above 650 MHz, with a typical return loss in the range of near 20 dB at 400 MHz. This level of performance has been found acceptable by reputable 10G PHY vendors and customers.

Methods of Manufacture of Integrated Connector Modules—

Figure 2A:
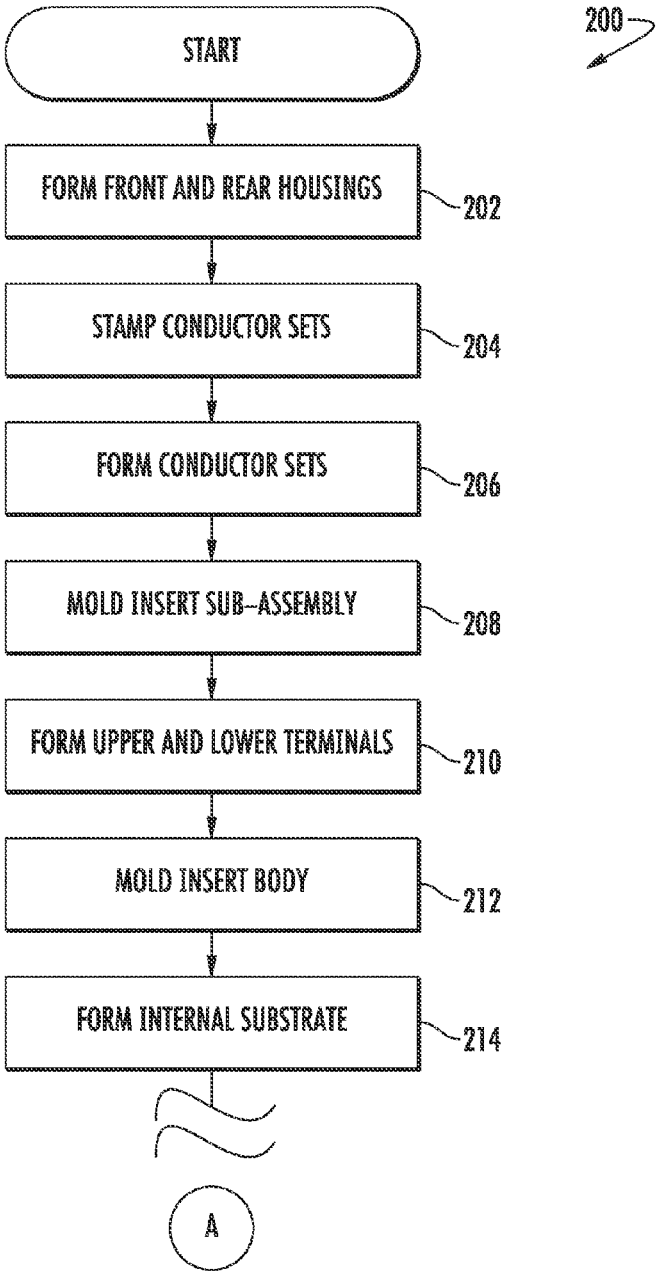
FIGS. 2A-2C are a process flow diagram illustrating one exemplary embodiment of a method for manufacturing an ICM in accordance with the principles of the present disclosure.
Figure 2B:
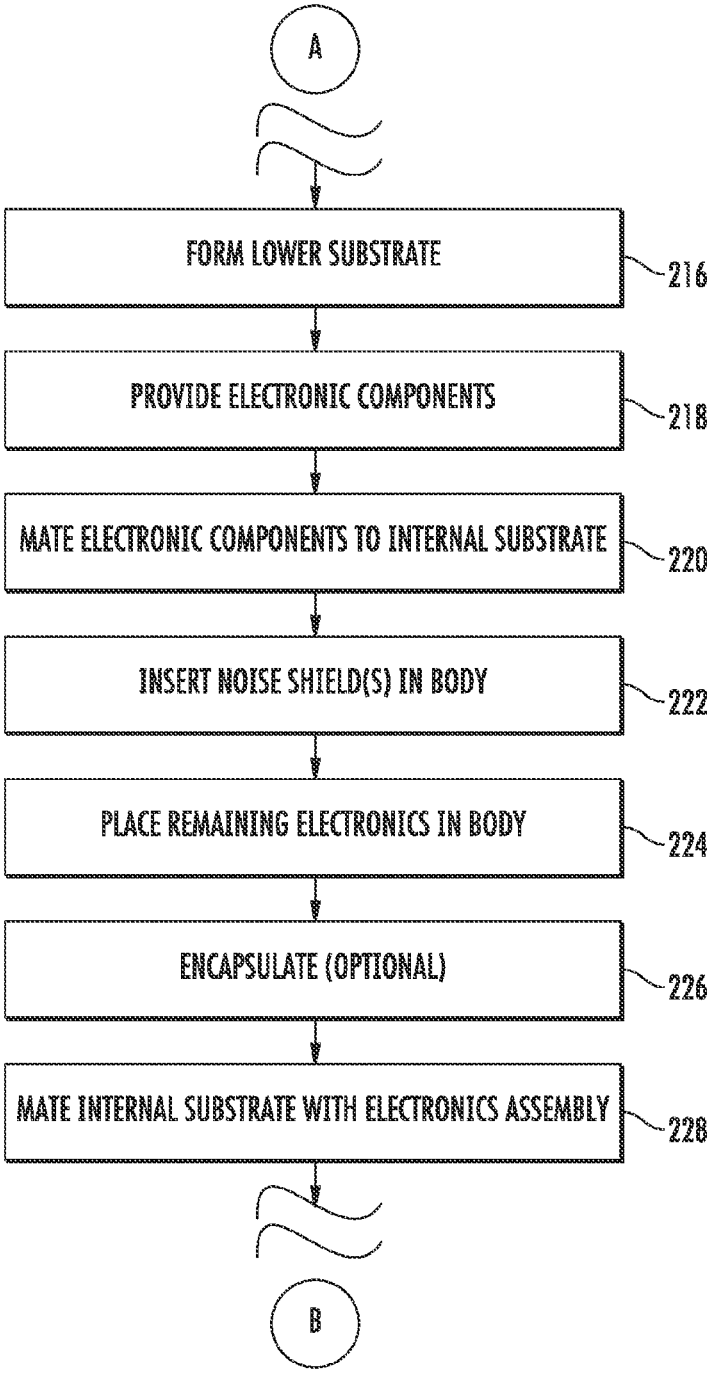
Figure 2C:
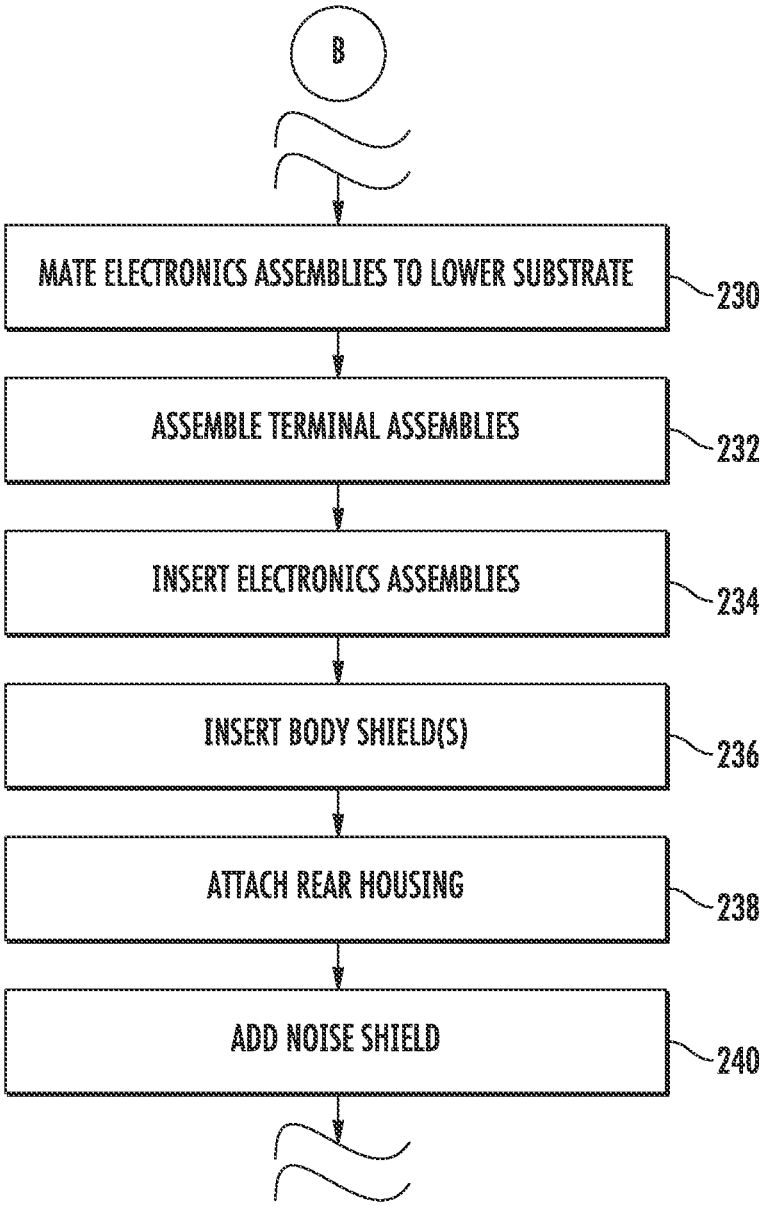

Referring now to FIGS. 2A-2C, an exemplary method 200 of manufacturing the ICM connector assembly 100 illustrated in FIG. 1 is shown and described in detail. It is noted that while the following description of the method 200 of FIGS. 2A-2C is cast in terms of the specific ICM connector assembly embodiment illustrated in FIG. 1, the broader method of the present disclosure is equally applicable to other embodiments described herein with proper adaptation being readily apparent to one of ordinary skill given the present disclosure.

At step 202 of the method 200, the front and rear housings are formed. The housings are formed using well-known injection molding processes. The injection molding process is chosen for its ability to accurately replicate small details of the mold, low cost, and ease of processing. In an exemplary embodiment, the housings are formed at a third party manufacturer where they are packaged and transported to the ICM manufacturer, although indigenous molding or other formation processes (or yet other approaches) may be used with equal success.

At step 204, conductor sets are stamped for use with the contacts (e.g., Federal Communications Commission (FCC) contacts) used within the ports of the underlying ICM connector assembly. In an exemplary embodiment, the conductor sets comprise a metallic alloy (e.g., copper or nickel-based alloy) having a substantially rectangular cross-section.

At step 206, the conductor sets are formed into a desired shape(s) using for example a progressive stamping die of the type well known in the art. Preferably, steps 204 and 206 are performed using the same progressive stamping die so as to economize on the production of the conductor sets. In an exemplary embodiment, the conductor sets are stamped and formed at a third party manufacturer where they are packaged and transported to the ICM manufacturer.

At step 208, the first and second conductor sets are insert-molded within a polymer header thereby forming a terminal insert sub-assembly. Again, in an exemplary embodiment, the terminal insert sub-assemblies are stamped and formed at a third party manufacturer where they are packaged and transported to the ICM manufacturer.

At step 210, the upper and lower terminals to be mounted into an insert body are formed. In an exemplary embodiment, the upper and lower terminal are formed using similar methods to those used for the conductors formed at steps 204 and 206; i.e., the upper and lower terminals are formed from a flat metallic sheet using a progressive stamping die. In one variant, the upper and lower terminals may also be notched (not shown) at their distal ends such that electrical leads associated with the electronic components (e.g., fine-gauge wire wrapped around the magnetic toroid element) may be wrapped around the distal end notch to provide a more secure electrical connection. Alternatively, the upper and lower terminals may be formed from wire stock that may, for example, be wound onto a spool useful for automated processing techniques.

At step 212, the insert body of the electronics sub-assembly 150 is formed, such as via well-known processing techniques like injection molding or transfer molding. In one embodiment, a high-temperature polymer of the type ubiquitous in the art is used to form the insert body so as to enable the insert body to be resistant to deformation caused by high temperature soldering techniques. In an exemplary approach, the insert body is formed by insert molding the upper and lower terminals formed at step 210. Alternatively, the upper and lower terminals could be post inserted into the molded insert body. Again, in an exemplary embodiment, the electronics sub-assembly is formed at a third party manufacturer where they are packaged and transported to the ICM manufacturer, or alternatively indigenously manufactured.

At step 214, the internal substrate is formed and perforated (or drilled) through its thickness with a number of apertures. Methods for forming substrates are well known in the electronic arts, and accordingly are not described further herein. Any conductive traces on the substrate required by the particular design are also added, and conductive pathways are arranged to electrically couple the conductor sets with the upper terminals when assembled. The apertures of the internal substrate are arranged into a desired pattern. Any number of different methods of forming the apertures on the substrate may be also be used, including a rotating drill bit, punch, heated probe, or even laser energy.

At step 216, the lower substrate is formed in a similar fashion as the internal substrate formed at step 214. In an exemplary embodiment, the internal substrate and lower substrate are formed at a third party manufacturer where they are packaged and transported to the ICM manufacturer.

At step 218, one or more electronic components, such as the aforementioned toroidal coils and surface mount electronic components, are provided. In an exemplary embodiment, the toroidal coils are formed as substrate inductive devices using the automated techniques described in co-owned U.S. patent application Ser. No. 12/876,003 filed Sep. 3, 2010 and entitled "Substrate Inductive Devices and Methods", now issued as U.S. Pat. No. 8,591,262 on Nov. 26, 2013, the contents of which are incorporated herein by reference in its entirety. Moreover, it will be appreciated that one or more of the various design features described herein may be adapted to other ICM internal configurations, such as for example those described in co-owned U.S. patent application Ser. No. 12/876,003 filed Sep. 3, 2010 and entitled "Substrate Inductive Devices and Methods", now issued as U.S. Pat. No. 8,591,262 on Nov. 26, 2013, the contents of which were incorporated herein by reference in its entirety above.

The relevant electronic components are then mated to the internal substrate at step 220. Note that if no components are used, the conductive traces formed on/within the primary substrate will form the conductive pathway between the first and second sets of conductors and respective ones of the upper and lower terminals. The components may optionally be (i) received within corresponding apertures designed to receive portions of the component (e.g., for mechanical stability), (ii) bonded to the substrate such as through the use of an adhesive or encapsulant, (iii) mounted in "free space" (i.e., held in place through tension generated on the electrical leads of the component when the latter are terminated to the substrate conductive traces and/or conductor distal ends, or (iv) maintained in position by other means. In one embodiment, the surface mount components are first positioned on the primary substrate, and the magnetics (e.g., toroids) positioned thereafter, although other sequences may be used. The components are electrically coupled to the PCB using a eutectic solder re-flow process as is well known in the art.

At step 222, the internal noise shield is inserted into the insert body via a formed slot to isolate the two separate cavities contained within the insert body. In one embodiment, the internal noise shield is inserted after the insert body has been formed. Alternatively, the internal noise shield is insert-molded during the forming of the insert body.

At step 224, the remaining electrical components are disposed within the cavities of the insert body. In an exemplary embodiment, these remaining electrical components comprise wire wound toroids with the ends of the wires being routed and secured to respective ones of the upper and lower terminals using known techniques such as soldering, welding and the like.

At step 226, the electronic components disposed within the insert body are optionally encapsulated with an encapsulant such as silicone or an epoxy.

At step 228, the assembled internal substrates are mated with the insert assembly sub-structure such that the upper terminals are disposed in their corresponding apertures of the internal substrate. The terminals are then bonded to the substrate contacts such as via soldering or welding to ensure a rigid electrical and mechanical connection for each. The completed insert assembly may then be optionally electrically tested to ensure proper operation if desired.

At step 230, the completed electronics sub-assemblies are mated to the common lower substrate and bonded thereto if desired to as to form a substantially rigid insert structure.

At step 232, the terminal insert assemblies previously formed are assembled onto the completed electronic sub-assemblies assemblies that are mated to the common lower substrate.

Next, the completed insert structures of step 232 are inserted into the housing at step 234. In an exemplary embodiment, the completed insert structures are held within the housing purely mechanical retention features. Alternatively, the inserted electronic sub-assemblies are inserted into the housing and secured using secondary processing techniques such as heat staking or the use of an epoxy.

At step 236, the insert body shields are installed into the housing between each of the installed electronic subassemblies.

At step 238, the rear housing is attached to the rear end of the housing thereby enclosing the plurality of electronic sub-assemblies. In an exemplary embodiment, the rear housing is affixed to the housing via a snap-type mechanical connection. In an alternative variant, the rear housing is affixed with an adhesive, potting compound, or similar material. In yet another alternative variant, the rear housing is obviated altogether in configurations in which a single housing construction is used.

Lastly, at step 240, the external noise shields (if used) are added onto the assembled ICM so as to provide grounding for the assembled ICM. In an exemplary embodiment, the external noise shields are added using purely mechanical connections. In an alternative embodiment, the external noise shields are added using a combination of mechanical connections and secondary processing techniques such as soldering, welding and the like.

It will again be noted that while certain aspects of the present disclosure are described in terms of a specific sequence of steps of a method, these descriptions are only illustrative of the broader methods of the present disclosure, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the present disclosure and claimed herein.

While the above detailed description has shown, described, and pointed out novel features of the present disclosure as applied to various embodiments, it will be understood that various omissions, substitutions, and changes in the form and details of the device or process illustrated may be made by those skilled in the art without departing from the present disclosure. The foregoing description is of the best mode presently contemplated of carrying out the present disclosure.

This description is in no way meant to be limiting, but rather should be taken as illustrative of the general principles of the present disclosure. The scope of the present disclosure should be determined with reference to the claims.

What is claimed is:

1. An integrated connector module, comprising:

a connector housing comprising a plurality of connector ports arranged in a row-and-column fashion;

a plurality of sets of electronic components disposed within one or more insert bodies, formed as single piece unitary bodies, each of the sets of electronic components being associated with a given port in the connector housing; and a plurality of electromagnetic interference (EMI) reducing shields with each of the EMI reducing shields configured to isolate each of the sets of electronic components from one another;

wherein an EMI reducing shield is included within each of the one or more insert bodies so as to facilitate the EMI isolation of each of the sets of electronic components from one another.

2. The integrated connector module of claim 1, wherein the EMI reducing shield is insert molded within each of the one or more insert bodies.

3. The integrated connector module of claim 1, wherein the EMI reducing shield is received within a molded slot within each of the one or more insert bodies.

4. The integrated connector module of claim 3, wherein the molded slot is disposed proximately to a center of each of the one or more insert bodies.

5. The integrated connector module of claim 4, wherein the EMI reducing slot further comprises a plurality of grounding pins, the grounding pins configured to provide an additional connection to a ground plane located on an external printed circuit board.

6. An integrated connector module, comprising:

a connector housing comprising a plurality of connector ports arranged in a row-and-column fashion;

a plurality of sets of electronic components disposed within a plurality of insert bodies, formed as single piece unitary bodies, each of the sets of electronic components being associated with a given port in the connector housing;

a plurality of press-fit contacts configured to interface the integrated connector module with an external printed circuit board; and a plurality of insert body shields;

wherein the plurality of insert body shields are configured to enable the use of the press-fit contacts by adding additional support to the connector housing.

7. The integrated connector module of claim 6, wherein the insert body shields are each disposed between adjacent insert bodies.

8. The integrated connector module of claim 7, wherein each of the insert body shields are supported at both the top of the housing and a lower substrate.

9. The integrated connector module of claim 8, further comprising a rear housing, the rear housing including one or more integrated support features that interface with one or more respective features in the insert body shields.

10. The integrated connector module of claim 9, wherein each of the insert body shields incorporates a grounding pin that provides additional grounding between the insert body shield and the lower substrate.

11. The integrated connector module of claim 6, wherein the insert body shields are separately received within the connector housing.

12. The integrated connector module of claim 6, wherein the insert body shields are insert molded within the connector housing.

13. The integrated connector module of claim 6, wherein the insert body shields are configured to act as a supportive beam which supports a top portion of the connector housing during press-fit installation onto the external printed circuit board.

14. An integrated connector module, comprising:

a connector housing comprising a plurality of connector ports arranged in a row-and-column fashion;

a plurality of sets of electronic components disposed within one or more insert bodies, the one or more insert bodies further comprising an internal printed circuit board;

a plurality of electromagnetic interference (EMI) shields configured to provide electrical isolation for the plurality of sets of electronic components;

the plurality of EMI shields further comprising a body shield that interfaces with the internal printed circuit board at least at a back portion of the internal printed circuit board to improve electrical isolation for the plurality of sets of electronic components; and a shielding tab disposed at least partly within at least one of the plurality of connector ports, the shielding tab configured to provide electrical connectivity between the internal printed circuit board and the body shield at a front portion of the internal printed circuit board.

15. The integrated connector module of claim 14, wherein the shielding tab is secured against the internal printed circuit board with a mechanical retentive force.

16. The integrated connector module of claim 15, wherein the shielding tab comprises at least two shielding tabs, the at least two shielding tabs configured to interface with the internal printed circuit board on a top and a bottom surface of the internal printed circuit board.

17. The integrated connector module of claim 14, further comprising a wall structure that separates the shielding tab from a plurality of electrical conductors disposed within the plurality of connector ports.

18. The integrated connector module of claim 14, wherein the plurality of the EMI shields comprises a rear grounding tab, the rear grounding tab configured to interface with the internal printed circuit board on a top and a bottom surface of the internal printed circuit board.

* * * * *